US005441267A

United States Patent [19]

Alder

[11] Patent Number: 5,441,267

[45] Date of Patent: Aug. 15, 1995

[54] PORTABLE GOLF TARGET STAND

[76] Inventor: Ivan P. Alder, 420 Devendorf St., Elkhorn, Wis. 53121

[21] Appl. No.: 346,034

[22] Filed: Nov. 29, 1994

[51] Int. Cl.[6] ..... A63B 69/36; G09F 17/00

[52] U.S. Cl. ..... 273/177 R; 273/181 R; 273/407; 116/173

[58] Field of Search ..... 273/177 R, 181 R, 181 A, 273/407; 116/173

[56] References Cited

U.S. PATENT DOCUMENTS 2,372,111 3/1945 Norberg ..... 273/407
2,618,484 11/1952 Bishop ..... 273/407
4,080,925 3/1978 Moore ..... 116/173 X
4,171,134 10/1979 Reck ..... 273/181 R
4,407,505 10/1983 Kendziorski ..... 273/177
5,179,907 1/1993 Galbraith ..... 116/173 X

*Primary Examiner*—George J. Marlo

[57] ABSTRACT

A portable golf target stand having a base member, with the base member including pivotally mounted legs, with the legs arranged in a canted orientation relative to a top wall of the base member, such as the legs are arranged for inter-folding configuration to orient the leg members in a substantially parallel relationship when thusly inter-folded, with a signal rod arranged for selective reception within the base member, and the signal rod arranged for a break-down configuration for ease of storage of the signal rod when separated from the base member.

7 Claims, 4 Drawing Sheets

PORTABLE GOLF TARGET STAND

TECHNICAL FIELD

The field of invention relates to golf accessory structure, and more particularly to a new "portable golf target stand" wherein the same is arranged for ease of transport, storage, and positioning as desired relative to providing a portable target in play of and practice for golf sporting events.

BACKGROUND OF ,THE INVENTION

Prior art practice golf flags and the like are indicated in the prior art and exemplified by patents such as U.S. Pat. No. 4,407,505, wherein a base member includes a spike to secure a post of inter-fitting sections together, secured together by severable connecting structure.

U.S. Pat. No. 5,163,684 sets forth a ring having a post and flag structure, wherein the ring is arranged to receive "chip shots" in practice of golf.

U.S. Pat. No. 5,005,512 is directed to a portable and extensible flag pole that is stored within a container, with the flag pole arranged for positioning within a pre-existing golf cup and the like.

U.S. Pat. No. 5,028,081 sets forth an example of a golf flag structure that is arranged for projection into underlying turf.

SUMMARY OF THE INVENTION

The "portable golf target stand" of the instant invention is arranged to provide for a readily collapsed, interfolded, and stored construction that may be arranged in a manner for ease of transport and storage, but is readily available for extension and positioning upon a golf turf for providing a temporary target. Foldable legs, as well as a collapsible and separable signal rod structure is provided, with the signal rod having a flag member at a distal end portion of the signal flag. An elastomeric cord directed throughout the signal rod maintains the signal rod and its components together.

Objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DESCRIPTION OF THE PREFERRED EMBODIMENT

As required, detailed embodiments of the present invention are disclosed herein; however, it is to be understood that the disclosed embodiments are merely exemplary of the invention, which may be embodied in various forms. therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
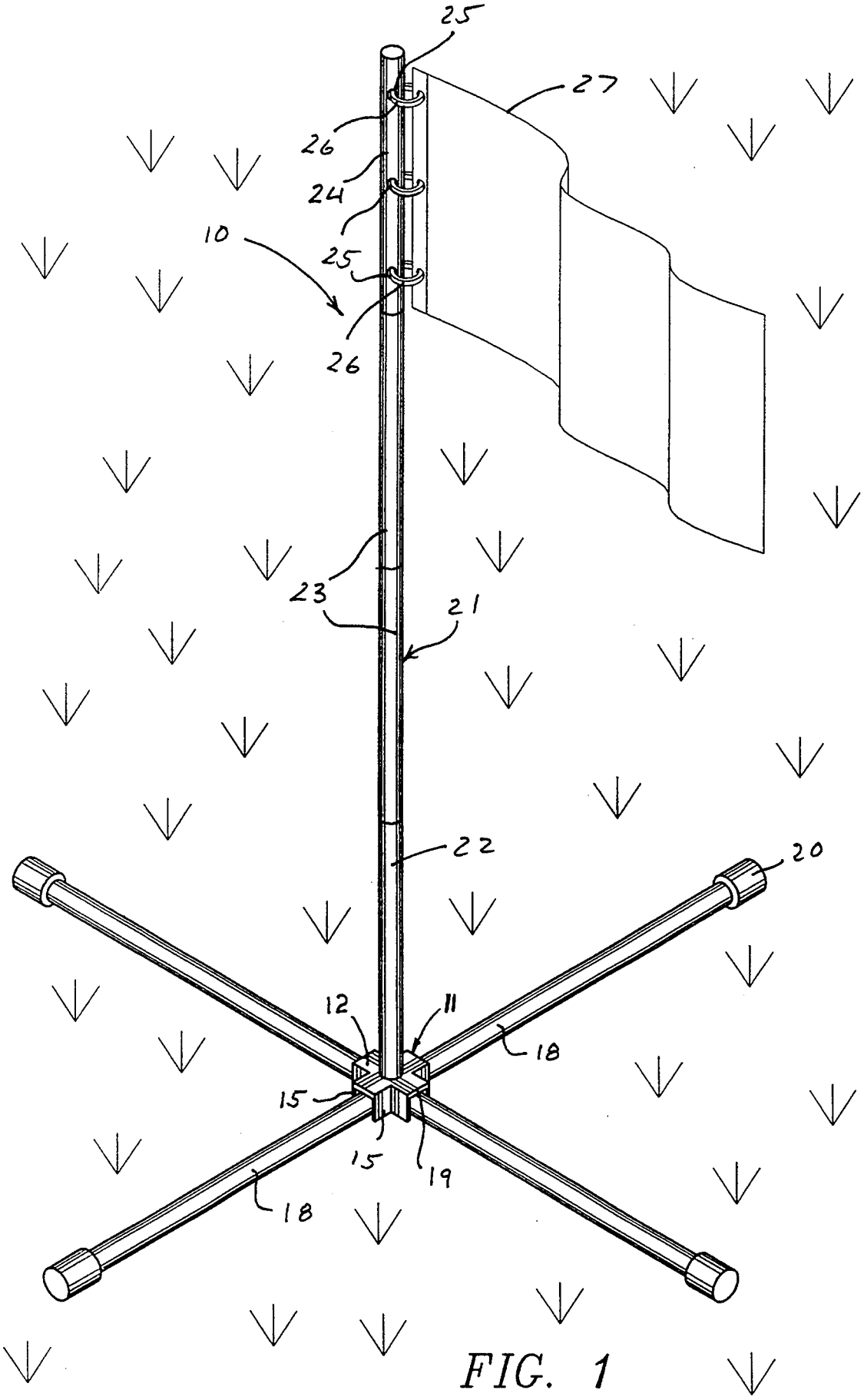
FIG. 1 is an isometric illustration of the invention.
Figure 2:
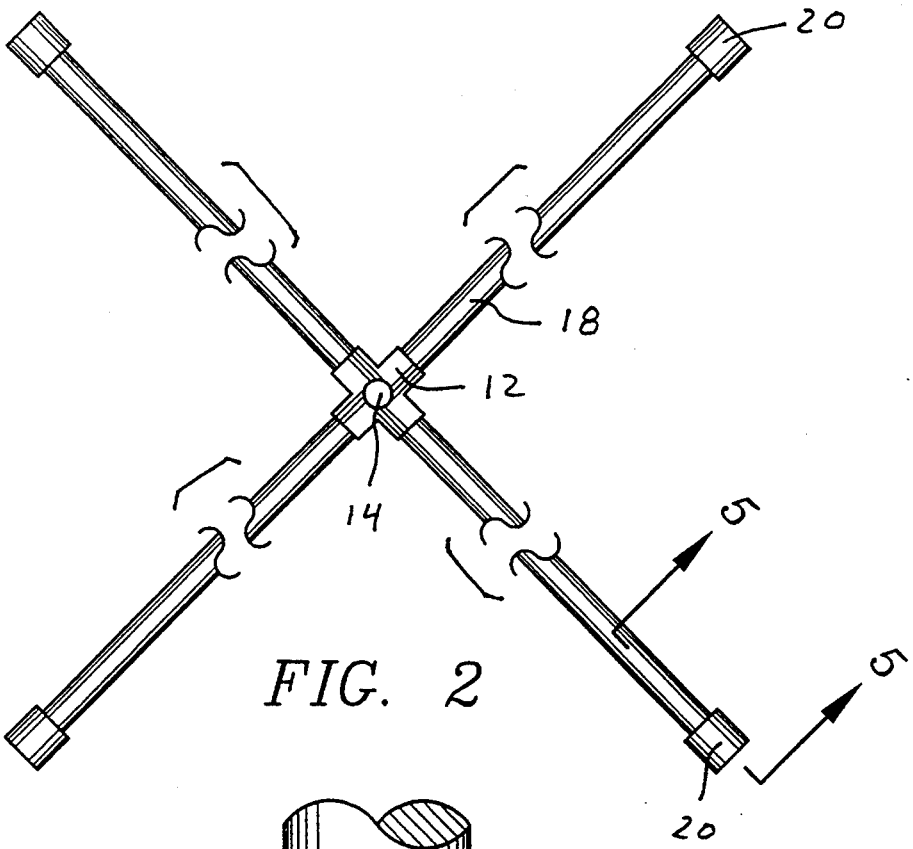
FIG. 2 is an orthographic top view of the base member and legs extending therefrom.
Figure 3:
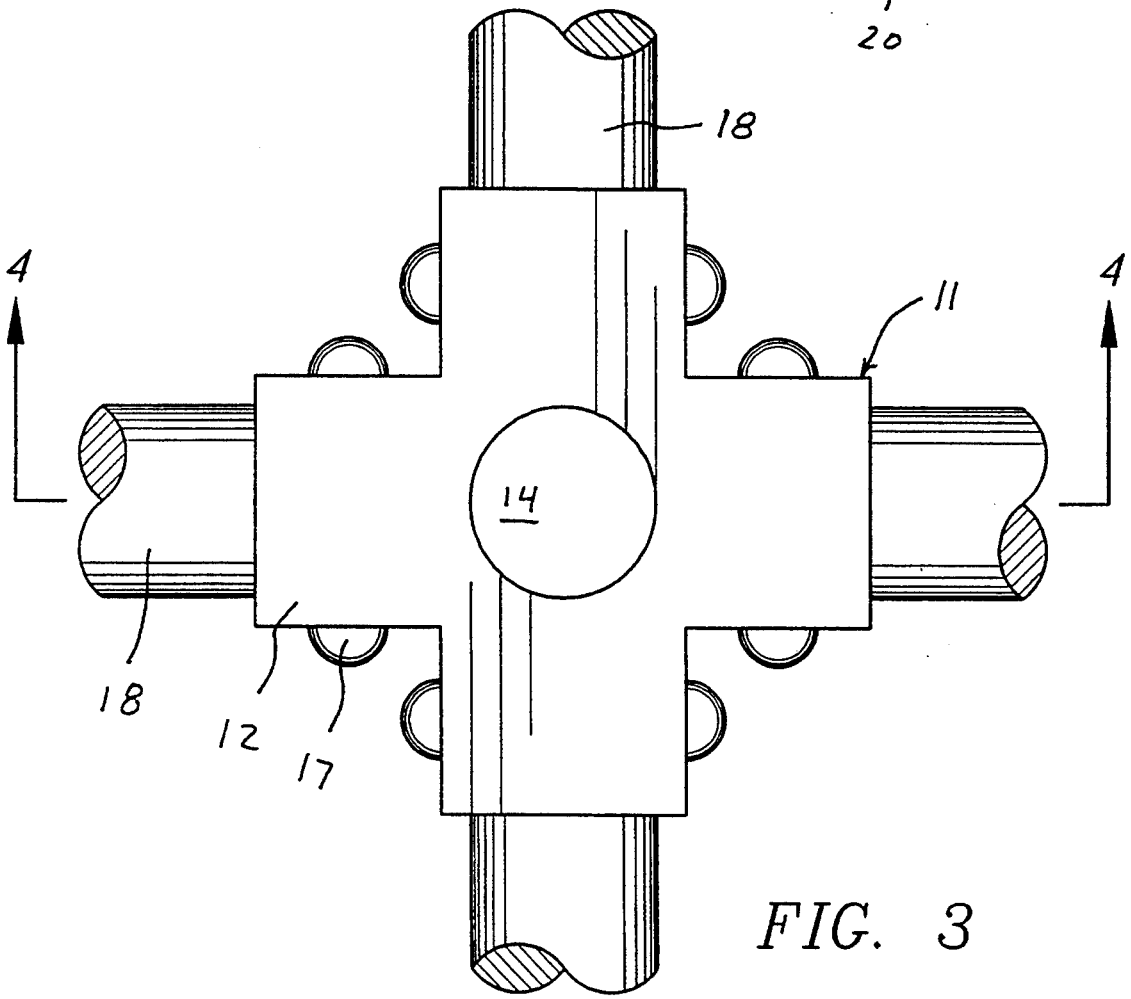
FIG. 3 is an enlarged plan view of the base member indicating each leg in a partial view extending therefrom.
Figure 4:
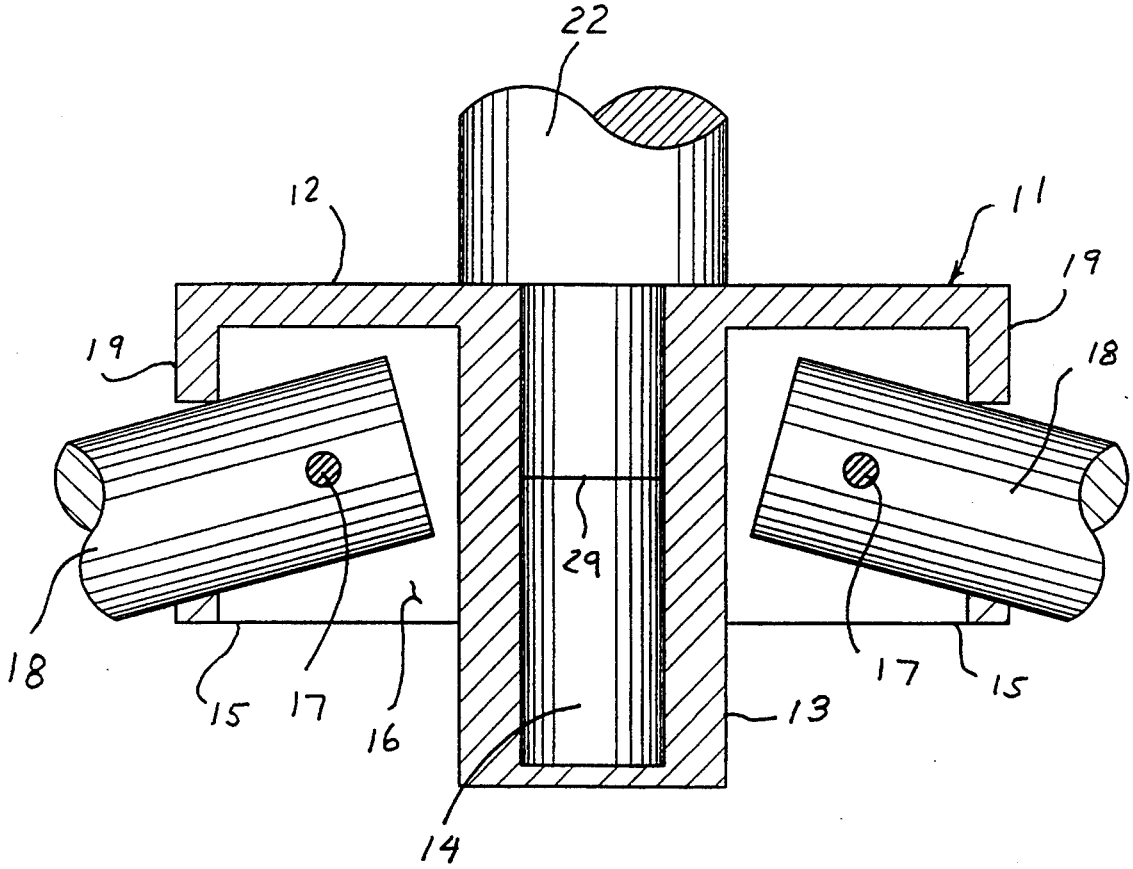
FIG. 4 is a cross-sectional illustration of the base member, taken along the lines 4—4 as indicated in FIG. 3.
Figure 5:
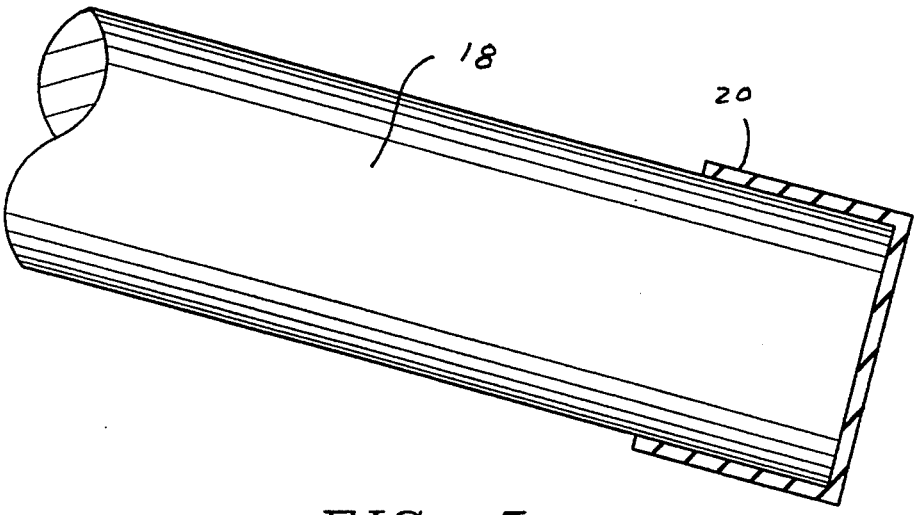
FIG. 5 is an enlarged cross-sectional view, taken along the lines 5—5 of FIG. 2.

The portable golf target stand 10 of the invention comprises a base member 11, having a top wall 12, with a tubular member 13 extending below the top wall (see FIG. 4), such that the tube member 13 is provided with a bore 14 coaxially of the top wall 12 to receive a signal rod 21, such as indicated in FIG. 1. Spaced pairs of flanges 15, to include at least three such pairs of flanges, extend below the top wall 12, wherein each pair of flanges defines a leg receiving cavity 18 to pivotally mount a leg member 18 within each respective leg cavity 18 about an axle 17 (see FIG. 4). An abutment flange 19 extending between each pair of flanges 15 is integral with the top wall to engage and abut the respective leg member 18 within a respective leg receiving cavity 18 to cant each leg member 18 at an acute angle relative to the top wall 12 to thereby space the tube member 13 relative to an underlying turf, as well as enhanced stability of the organization when thusly oriented to an underlying turf, such that each outer distal end of each leg member 18 is provided with a cover tube 20 to protect that outer distal end as well as the underlying turf. In this manner, the leg members may be interfolded in an orientation substantially parallel to the tube member 13 to provide for a compact organization for storage of the base member 11.

Figure 6:
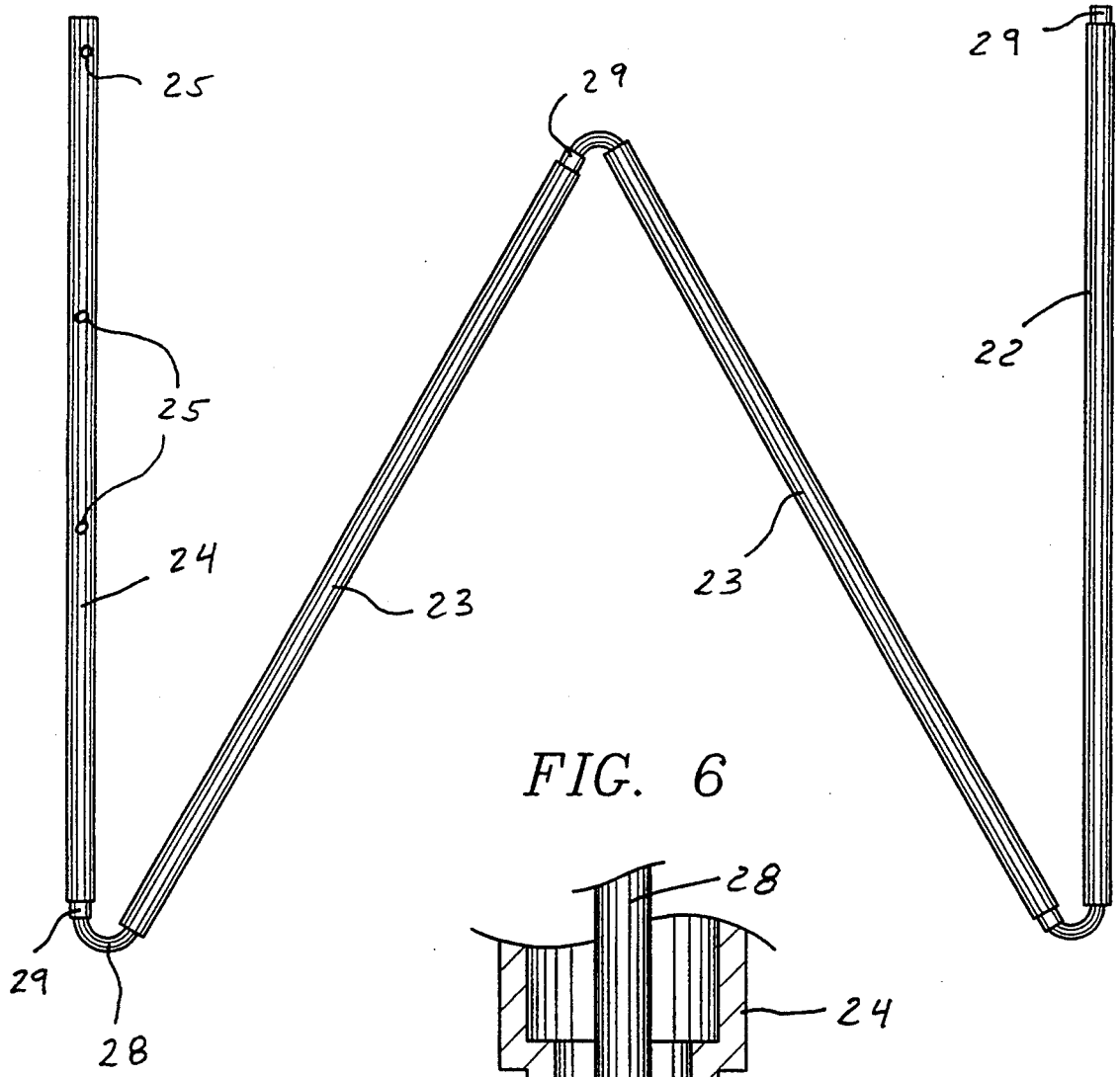
FIG. 6 is a top plan view indicating the signal rod in a "break-down" configuration.
Figure 7:
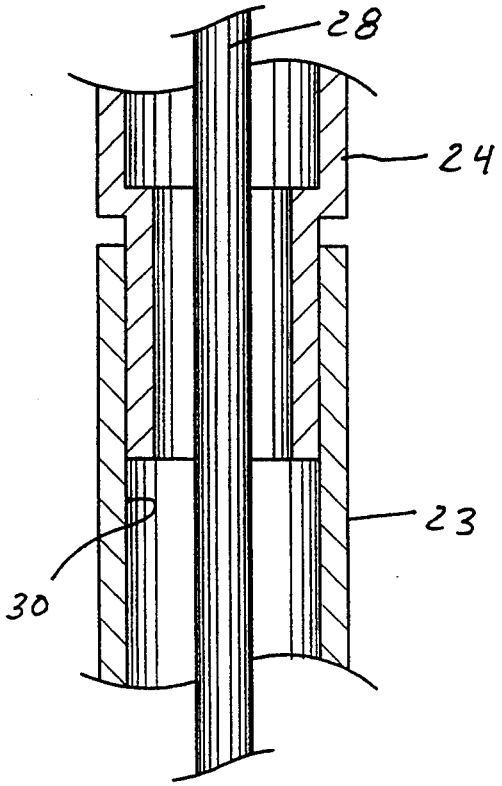
FIG. 7 is an enlarged cross-sectional illustration of a plurality of the signal rod tubes arranged for inter-fitting relative to one another.

The signal rod 21 is formed of a plurality of tube sections defined by a base rod tube 22, at least one and typically a plurality of intermediate rod tubes 23, and a distal rod tube 24. The distal rod tube 24 includes a plurality of spaced apertures 25, each such aperture 25 having a ring support 26, such that each of the ring supports is arranged to secure a flag 27 to enhance visible observation of the target structure 10. An elastomeric cord 28 is directed through each bore of the tube sections (see FIGS. 6 and 7) to secure the tubes together, but yet the tubes 24, 23, and 22 may be separated, such as indicated in FIG. 6, for compact storage but secured together by the elastomeric cord. To this end, each of the tubes 22, 23, and 24 is provided with a projecting boss 29, such that the base rod tube projection boss is received within the bore 14, with the intermediate tube projecting bosses 29 inter-fitting relative to an adjacent receiving bore 30 (see FIG. 7) of an adjacent tube, such that the tubes may be interfitted and aligned relative to one another in an orientation substantially coaxially aligned relative to the base member 11 and specifically to the top wall 12. To this end, each of the tubes 22, 23, and 24 are of a substantially equal outer diameter, with each projecting boss 29 of a lesser diameter, such that when the tubes are assembled, the outer surface of the signal rod 21 is of a constant and uninterrupted exterior surface.

Accordingly, the portable golf target stand 10 of the invention provides an organization arranged for ease of transport, storage, and ease of positioning relative to a golfing event for providing a convenient target for a golfer to direct a golf ball in practice, and the like.

It is to be understood that while certain forms of the present invention have been illustrated and described herein, it is not to be limited to the specific forms or arrangement of parts described and shown.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed and desired to be protected by letters patent of the United States is as follows:

1. A portable golf target stand, comprising, a base member, the base member receiving a signal rod, the base member having a top wall and the top wall having a tube member extending below the top wall, the tube member having a bore for selective reception of the signal rod, and a plurality of leg members pivotally mounted to the base member and extending therefrom.

2. A target as set forth in claim 1 with the base member having plural pairs of flanges extending below the top wall, with each pair of said flanges defining a leg receiving cavity receiving a leg member of said plurality of legs within the leg receiving cavity, and a plurality of axles, with one axle of said plurality of axles extending within each said cavity for pivotally mounting said leg member therewithin, and each pair of flanges having an abutment flange extending from a periphery of the base member between each said pair of flanges to engage said leg member within said cavity to cant said leg member at an acute angle relative to the top wall.

3. A target as set forth in claim 2 with the signal rod including a plurality of tube sections, wherein said tube sections include a base tube, at least one intermediate tube, and a distal tube, the distal tube having a flag mounted to the distal tube.

4. A target as set forth in claim 3 wherein the distal tube includes a plurality of apertures, and each aperture of said plurality of apertures having a ring support, and the flag secured to each said ring support to pivotally mounted the flag to the distal tube.

5. A target as set forth in claim 4 wherein the base tube includes a base tube projecting boss for selective reception within the bore of said base member.

6. A target as set forth in claim 5 wherein the base tube, the intermediate tube, and the distal tube comprise a respective base tube bore, intermediate tube bore, and distal tube bore, with an elastomeric cord extending throughout the base tube bore, intermediate tube bore, and the distal tube bore.

7. A target as set forth in claim 6 wherein the intermediate tube includes an intermediate tube projecting boss for selective reception within the base tube spaced from the base tube projecting boss, and the distal tube includes a distal tube projecting boss for reception within the intermediate tube spaced from the intermediate tube projecting boss, with the base tube, the intermediate tube, and the distal tube arranged in a linearly aligned relationship when secured together and oriented coaxially of the base member when the base tube projecting boss is received within the bore.

* * * * *